United States Patent [19]

Blatt et al.

[11] Patent Number: 4,475,863

[45] Date of Patent: Oct. 9, 1984

[54] ELECTRIC SERVO DRIVE LIFT UNIT

[76] Inventors: Leland F. Blatt; John A. Blatt, both of 31915 Groesbeck Hwy., Fraser, Mich. 48026

[21] Appl. No.: 381,146

[22] Filed: May 24, 1982

[51] Int. Cl.[3] ..... F16H 1/04; B65G 57/20

[52] U.S. Cl. ..... 414/589; 74/89.15; 414/753; 414/732

[58] Field of Search ..... 414/222–225, 414/751–753, 744, 732, 589, 596; 74/89.15, 41, 583; 248/162.1, 419, 325; 92/140

[56] References Cited

U.S. PATENT DOCUMENTS

| | | | |
|---|---|---|---|
| 2,943,750 | 7/1960 | Sehn et al. | 414/739 X |
| 3,665,771 | 5/1972 | Blatt | 74/89.12 X |
| 3,834,555 | 9/1974 | Bennington et al. | 414/744 B |
| 3,884,363 | 5/1975 | Ajlouny | 414/751 X |
| 4,193,731 | 3/1980 | Blatt et al. | 414/589 |
| 4,289,441 | 9/1981 | Inaba et al. | 414/589 |

*Primary Examiner*—Robert J. Spar
*Assistant Examiner*—Terrance L. Siemens
*Attorney, Agent, or Firm*—Cullen, Sloman, Cantor, Grauer, Scott & Rutherford

[57] ABSTRACT

A lift unit for a punch press comprising of a housing having a back plate mountable upon the press. A pair of upright tracks are mounted upon the back plate and spaced from a feed screw journaled upon the back plate. Spaced bearing blocks are secured upon outer edges of the carriage plate, each bearing block supporting a plurality of right angularly related cam followers operatively engaging opposite sides of the tracks and adjacent outer edges thereof for guidably mounting the carriage plate upon the tracks for reciprocal movements. A nut is secured to the carriage plate and threaded onto the feed screw. An encoder is connected to the feed screw. A programmable control or computer numerical control is connected to the motor and an electronic encoder feedback circuit interconnects the encoder with the programmable control or the computer numerical control. An angularly adjustable support cradle depends from the carriage below the housing and is adapted to mount a workpiece gripper tool adapted for programmed transverse controlled reciprocal movements relative to the press. The electronic encoder and programmable control or computer numerical control, controls the direction and number of rotations of the motor drive shaft for effecting a programmed repetitive cycle of predetermined feed movements of the carriage.

22 Claims, 12 Drawing Figures

271
175
177
173
167
283
283
39
165
49
212
59
191
165
171
49
83
233
229
234
235
241
223
227
225
223
89
5
287
271
5
287
285
283
167
3
3
25
165
213
217
27
209
247
245
269
267
149
51
263
37
269
267
251
179
11
11
269
267
245
247
41
187
185
49
81
81
253
235
243
233
241
232
237
255
229
257
233
231
239
259
87
225
89
223

51
53
55
57
68
69
70
71
73
75
77
79

ELECTRIC SERVO DRIVE LIFT UNIT

RELATED PATENT APPLICATIONS

Automation lift unit is shown in Applicant's copending U.S. patent application Ser. No. 287,765 filed July 29, 1981. An electronic servo drive shuttle unit is disclosed in Applicant's copending U.S. application Ser. No. 284,559 filed on July 20, 1981.

BACKROUND OF THE INVENTION

Heretofore in the use of punch presses having a die opening and a bed for forming a workpiece, there have been employed power actuated workpiece gripper tools adapted for timed reciprocal movements in a horizontal or angular plane for positioning a workpiece blank upon the bed, retracting and after a pressing operation feeding the gripper horizontally to successfully grip the workpiece and retract rearwardly lifting the workpiece from the press bed. Normally in such transverse movements of the gripper tool, there is a vertical component involved for conveniently elevating the workpiece from the press bed on retraction thereof and for thereafter vertically positioning the retracted workpiece in a predetermined vertical plane. The gripper tool is furthermore adapted to lift off the top blank or a stack of blanks in a vertical plane and lower the blank into registry with the die opening and for projection of the blank onto the die bed.

THE PRIOR ART

Devices of this type are shown in one or more of the following U.S. Pat. Nos.:

3,665,771 dated May 30, 1972, Stroke Multiplying Retractor Mechanism;

3,714,870 dated Feb. 6, 1973, Dual Grip Actuating Unit With Travel Cylinder Assembly;

3,734,303 dated May 22, 1973, Travel Cylinder and Gripper Acuator with Triple Guide Rods;

3,742,774 dated July 3, 1973, Adjustable Stroke Retractor Mechanism;

3,866,485 dated Feb. 18, 1975, Angular Adjustment Mount For A Workpiece Extractor;

4,193,731 dated Mar. 18, 1980, Adjustable Shuttle Mount for Presses.

The problem with devices of this type heretofore employed is to provide a positive automation type of control mechanism in conjunction with a workpiece extractor tool for a punch press or other machine tool wherein there may be a predetermined control regulating vertical adjustments of the workpiece gripper tool. There has been a need for a programmed cycle of reciprocal and interrupted vertical movements in conjunction with a workpiece gripper tool wherein there are controlled and/or programmable means for regulating the substantially horizontal or angular reciprocal movements of the gripper tool. Such horizontal movements are for delivering a workpiece onto the bed of a press, retracting the gripper tool before the machining operation and thereafter advancing the gripper tool for gripping and retracting the finished workpiece and for elevating the workpiece in a predetermined cycle.

SUMMARY OF THE INVENTION

An important object of the present invention is to provide a heavy duty, air counterbalanced, electrically operated device for controlling vertical motion to a very accurate degree.

An important feature of the present invention is to provide a DC motor operated ball screw together with an encoder feedback circuit to a programmable control or to a computer numerical control connected to the motor, and incorporated into a vertical lift unit. An electronic encoder is connected to the feed screw. The program control or computer numerical control determine the direction and number of rotations of the motor drive shaft for effecting a programmed repetitive cycle of predetermined vertical feed movements of the carriage which mounts an adjustable support cradle for a workpiece gripper tool.

A further feature is to provide in conjunction with the electronic encoder, a preset program control (PC) or a Computer Numerical Control (CNC) and an electronic encoder feedback circuit interconnecting the encoder and PC or CNC.

A further feature is to provide an automation lift unit which is designed to accelerate at relatively high speeds and to stop in numerous positions controlled by a preset program in the PC or CNC.

A further feature includes the present lift unit as the vertical axis of a robotic system and for carrying upon its adjustable support cradle a hanger mount assembly to which is suspended a substantially horizontal feed device programmed for horizontal, angular or compound motion pursuant to a program that is related to certain movements on a vertical axis as well as a substantially horizontal axis.

The present invention is further directed to a method of accurately controlling vertical motion coupling therewith horizontal motion and incorporating the two units for functioning together pursuant to programmed control.

A further feature is to provide within the automation lift unit, a housing having a back plate mounting upright tracks and journalling an upright feed screw driven by a motor and with a carriage guidably mounted and retained upon the tracks and threadedly engaging the feed screw.

There is employed a programmable DC motor on the housing whose drive shaft is coupled connected by pulleys and a belt to the feed screw. An adjustable support cradle depends from the carriage and is adapted to mount a workpiece gripper tool adapted for programmed horizontal, angular or compound movements relative to the press bed. An electronic encoder is connected to the feed screw and through an encoder feed back circuit to a PC or CNC controls the direction and number of rotations of the motor shaft for affecting a programmed repetitive cycle of predetermined feed movements of the carriage and the workpiece gripper tool connected thereto.

A further feature includes the use of a preset programmable control (PC) together with an electronic encoder feedback circuit interconnecting the encoder and PC or CNC.

A further feature incorporates in conjunction with the lift unit a cylinder and surge tank weight compensation assembly which includes a cylinder assembly which is pressurized, including a reciprocal piston and piston rod connected to the reciprocal carriage for floating the loaded adjustable cradle support thereon wherein the pressure developed within the cylinder assembly is adapted to overcome the weight of the entire assembly including the carriage and the loaded adjustable cradle support in order that the DC motor will actuate the telescoping assembly incorporated into the lift unit with a minimum of load necessary to rotate the feed screw selectively in opposite directions and accelerated speeds.

A further feature of the present invention is an improved cam roller mounting for the carriage plate upon a pair of rails for movably mounting the carriage plate upon and along said rails and retained thereon together with a lubricating system for delivering lubricant under pressure to each of the bearing assemblies of the corresponding cam rollers upon the carriage plate.

A further feature includes an improved electronic switch system wherein vertically adjustable upper and lower limit switches are mounted upon the backplate for de-energizing the motor drive for the feed screw under the control of a switch block mounted upon a switch actuator rod guidably mounted upon the backplate adjacent the limit switches and at one end connected to the carriage for movements in unison therewith.

These and other objects and features will be seen from the following Specification and claims in conjunction with the appended drawings.

THE DRAWINGS

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
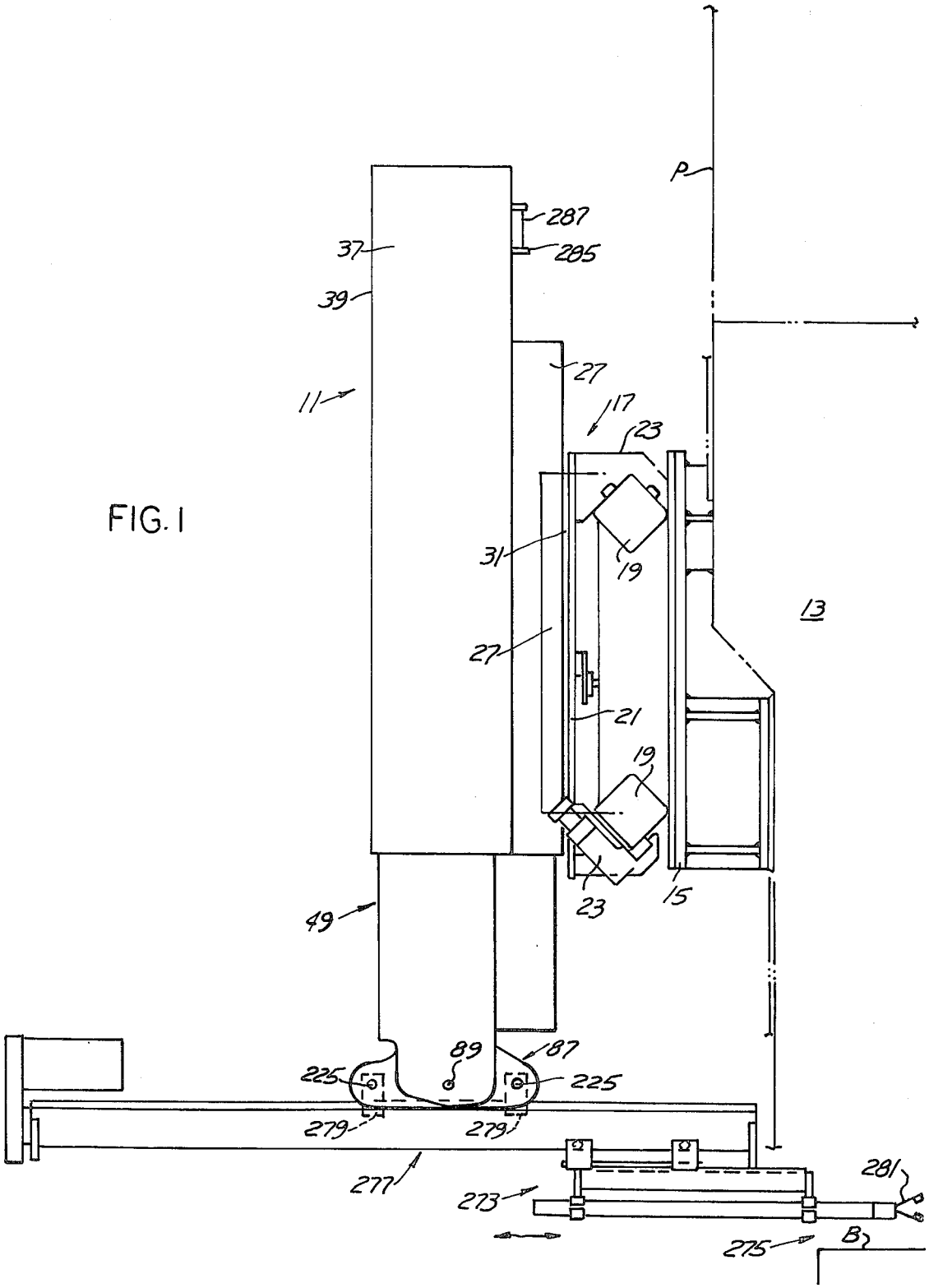
FIG. 1 is a schematic side elevational view of a punch press having a transverse shuttle mount thereon to which the present automation vertical lift unit is connected and which carries upon its telescoping carriage a horizontal retractable programmed feed mechanism for a workpiece gripper tool for movement relative to the press bed.

Referring to the drawings and particularly, FIG. 1, the present electric servo drive vertical lift unit 11 is mounted upon punch press P fragmentarily shown having a column 13 and connected thereto a transverse main frame 15. A horizontal adjustment shuttle mount 17 is mounted upon frame 15 and includes a pair of vertically spaced horizontal support tubes 19 upon which is mounted and supported the upright carriage plate 21 including at its upper and lower longitudinal edges the cross shuttle bracket including cam roller followers 23 which operatively engage and move along the corresponding support tubes 19.

This construction is shown and described in further detail in the U.S. Pat. No. 4,193,731 dated Mar.18, 1980 whose description is incorporated herein to the extent required for a full understanding of the transverse horizontal adjustment shuttle mount upon which the present vertical lift unit 11 is mounted.

Figures 2, 4:
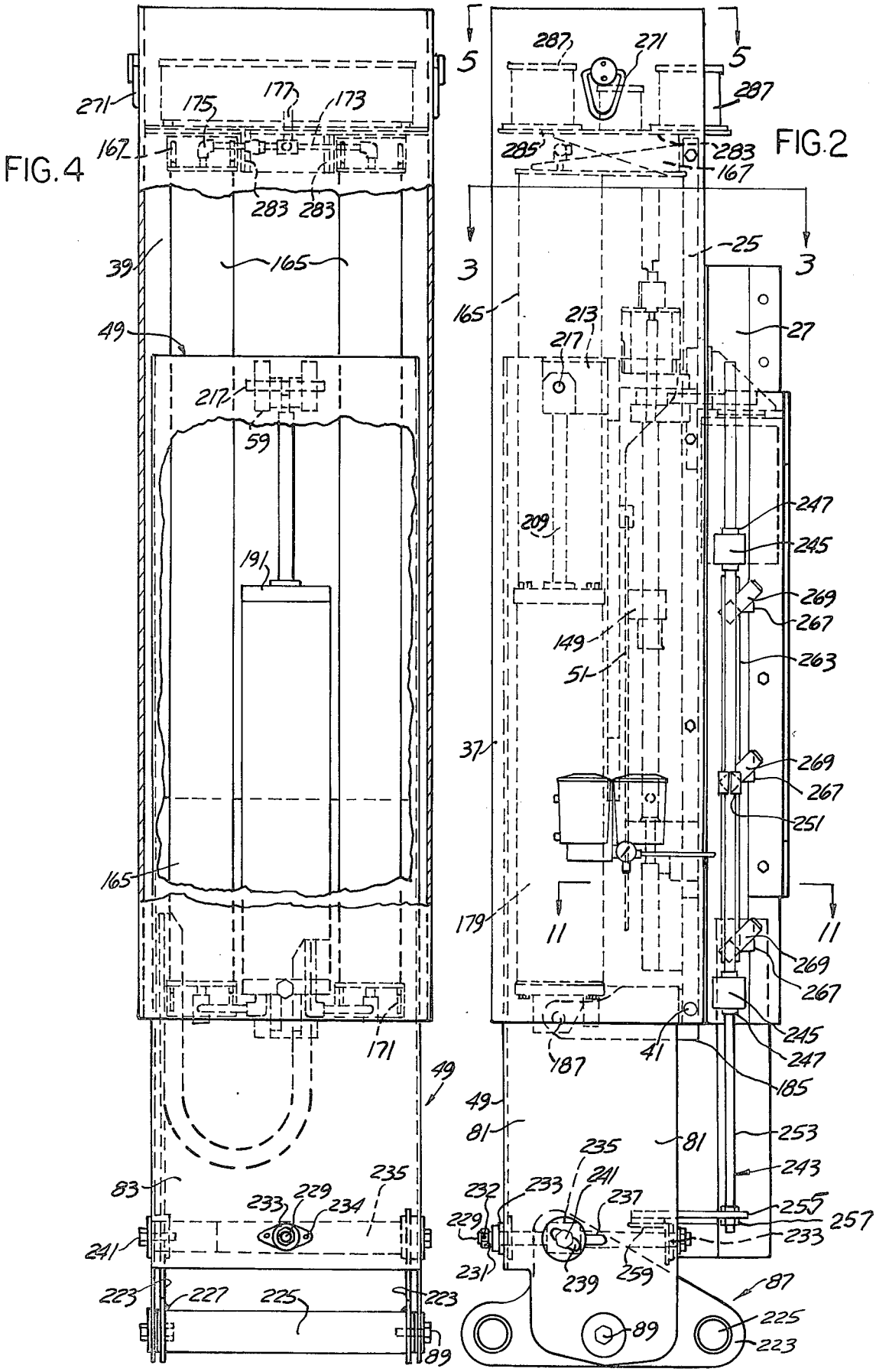
FIG. 2 is a side elevational view of the vertical lift unit shown in FIG. 1 with part of the covering therefor removed for clarity of illustration, and on an increased scale.
FIG. 4 is a front elevational view of the vertical lift unit shown in FIG. 2.
Figure 3:
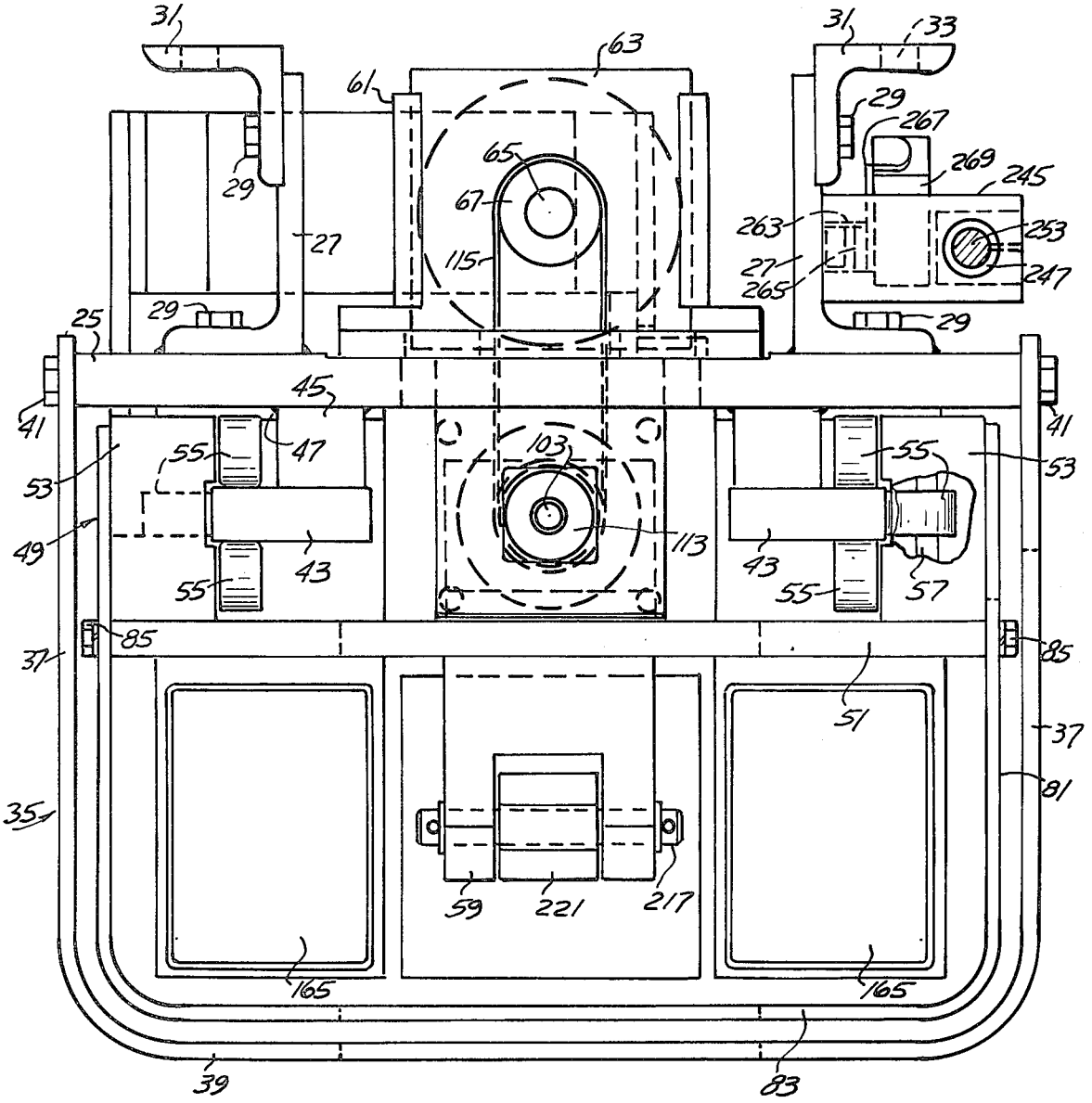
FIG. 3 is a fragmentary plan section taken in the direction of arrows 3—3 of FIG. 2, on an increased scale.

Referring to FIGS. 2, 3 and 4, the vertical lift unit includes an upright back plate 25 which mounts rearwardly thereof a pair of elongated upright angles 27 secured along their length to the back plate 25 as by fasteners 29 and additionally by welds as desired.

The mounting of the back plate upon the press and with respect to the upright carriage plate 21 thereon includes a pair of spaced elongated mounting angles 31 secured upon and along angles 27 by a plurality of fasteners 29 including a series of longitudinally spaced mounting holes or apertures 33 to facilitate the adjustable mounting of the back plate to the shuttle mount carriage plate 21, and in turn connected to the column of the press P in FIG. 1.

The verticle lift unit has an upright housing 35, FIGS. 2, 3 and 4 which include opposed side walls 37, a front wall 39. The side walls along their upright edges are secured to and along back plate 25 by a series of fasteners 41.

Figures 9, 10:
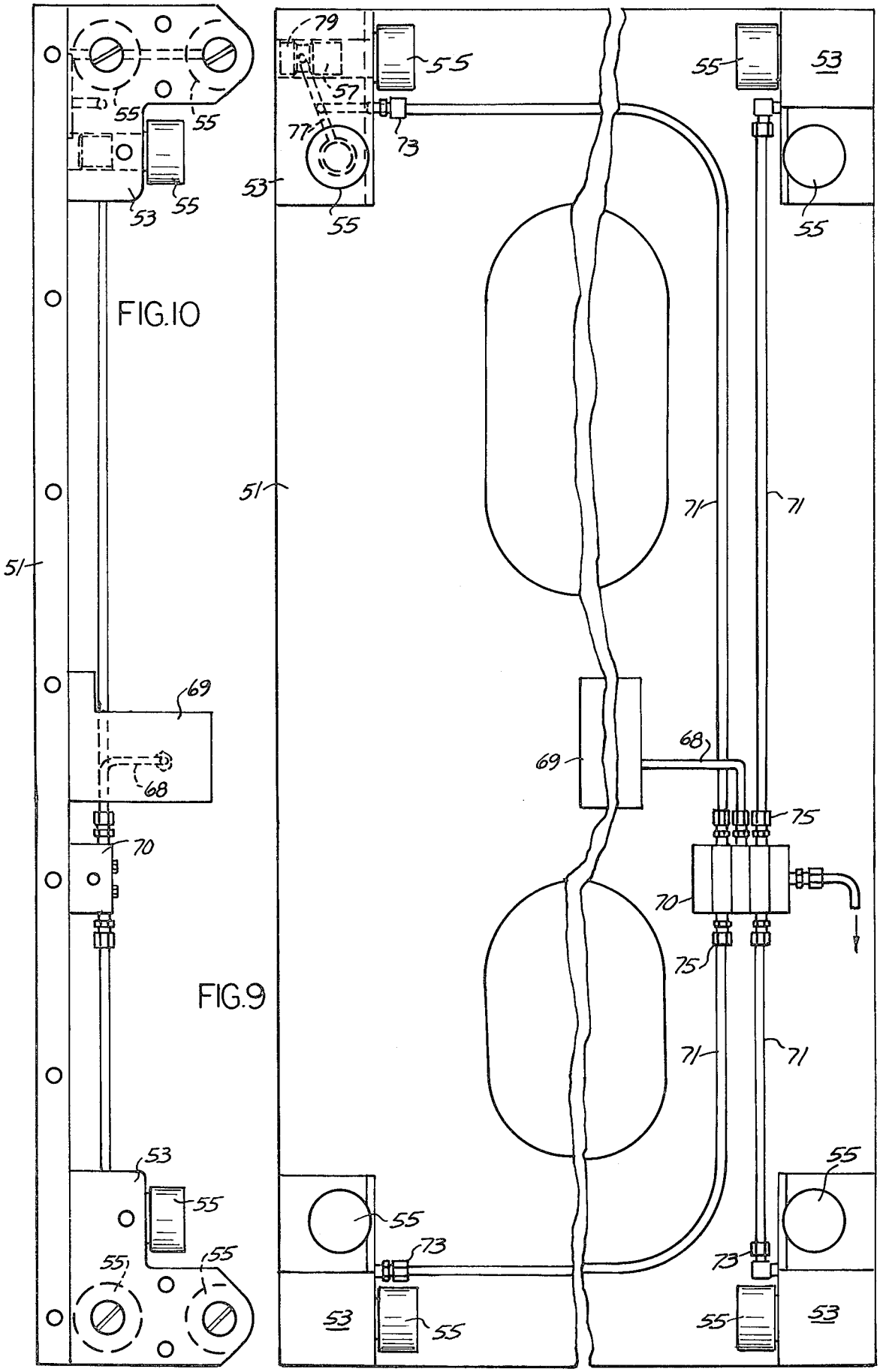
FIG. 9 is a rear elevational view of the carriage plate for the vertical lift unit, fragmentarily shown illustrating the cam followers upon the carriage for engagement with a pair of tracks.
FIG. 10 is a left side elevational view thereof.

A pair of upright parallel spaced tracks 43, rectangular in cross section, are secured in an upright position upon and along and parallel to back plate 25 forwardly thereof by a plurality of interposed track supports 45 secured to said back plate as by the welds 47. The telescoping mount carriage assembly 49 is movably mounted for controlled vertical adjustments within the housing 35 and includes an upright carriage plate 51. As shown in FIGS. 3, 9 and 10, the carriage assembly includes the vertically spaced bearing blocks 53 at the upper and lower ends of the carriage plate 51 upon opposite sides thereof and arranged rearwardly of said carriage plate as best shown in FIG. 3. Mounted within each of the bearing blocks 53 are a plurality of right angularly related cam followers 55, each having a stud shaft 57 supported and journaled upon the corresponding bearing block and secured thereto. By this construction corresponding cam followers or rollers supportably and operatively engage opposite sides of the tracks 43 and opposite edges thereof to provide a smooth guided rolling and mounting of the carriage plate 51 upon and along the tracks 43.

Figure 6:
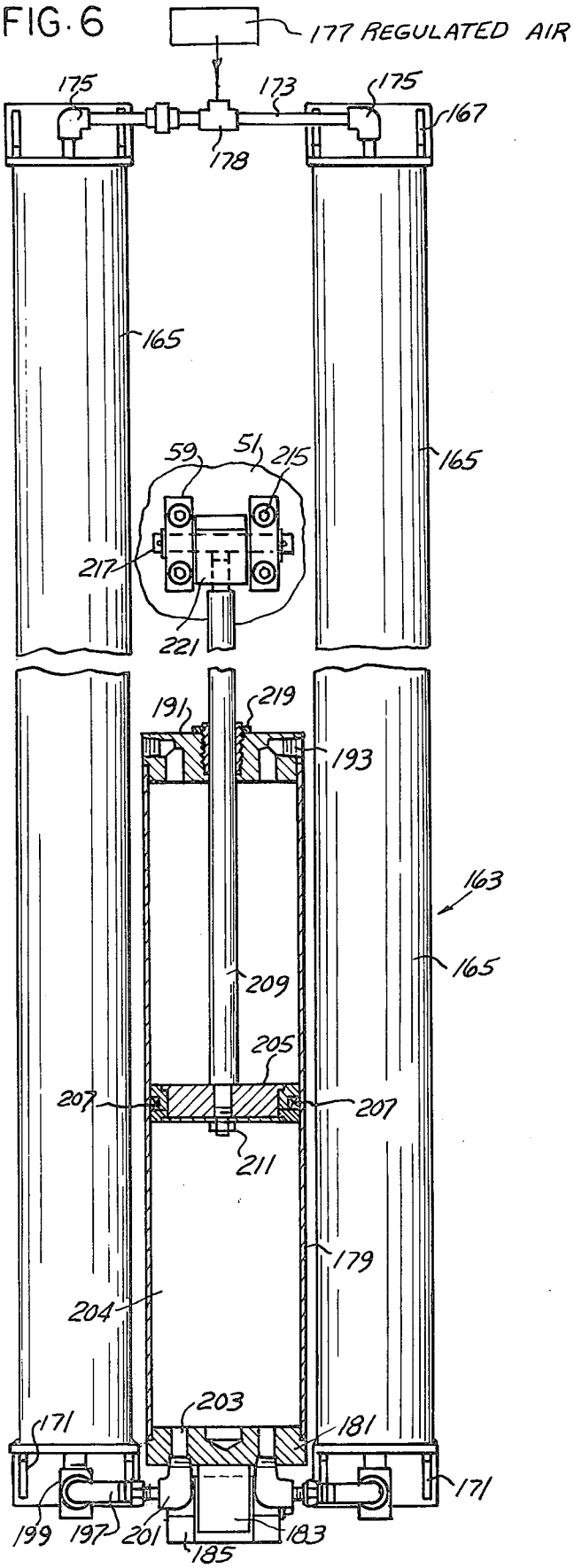
FIG. 6 is a front elevational view of the surge tank and cylinder assembly within the vertical lift unit shown in FIG. 1, on an increased scale and partly in section.
Figure 7:
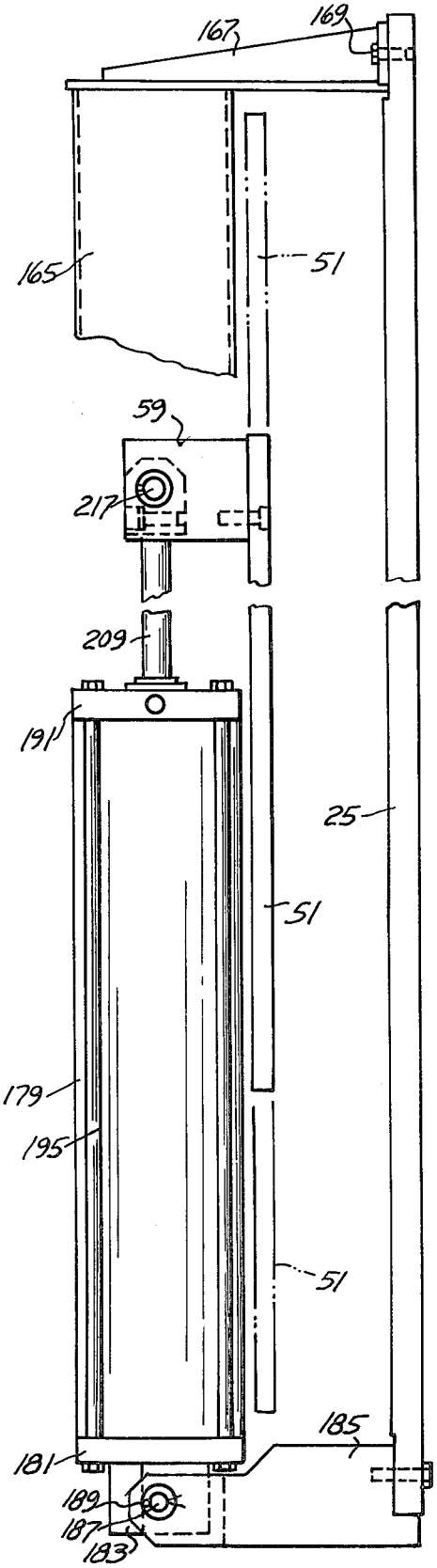
FIG. 7 is a fragmentary right side elevational view thereof illustrating the mounting of the surge tank and the pneumatic cylinder assembly and its connection to the reciprocal carriage forming a part of the vertical lift unit.

As shown in FIGS. 3, 6 and 7 projected from the opposite side of the carriage plate 51 intermediate its upper and lower ends is a split mount block 59 by which the carriage plate forming a part of the telescoping carriage assembly is counterbalanced by a pneumatic system hereafter described.

MOTOR MOUNT AND FEED SCREW ASSEMBLY

Figures 8, 8A:
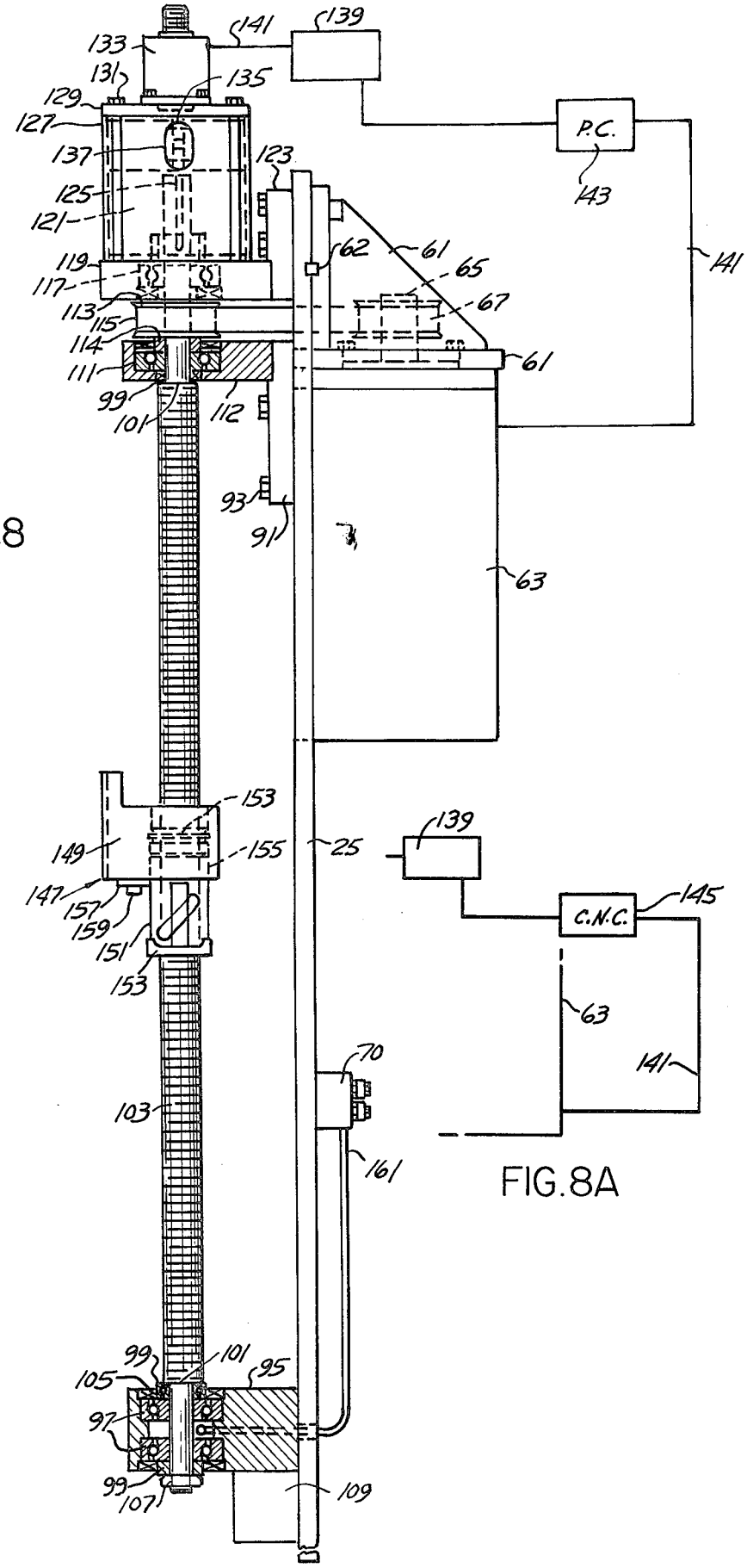
FIG. 8 is a fragmentary side elevational view of a portion of the vertical lift unit shown in FIG. 1, on an increased scale specifically showing the power drive including the motor and the interconnected carriage feed screw and the mounting therefore including a schematic block diagram of the electrical circuitry for a programmed control of the motor.
FIG. 8A is a fragmentary view similar to the block diagram of FIG. 8, showing a C.N.C. control of the motor.

Referring to FIGS. 2, 3, 5 and 8 and particularly FIG. 8, a machined motor mount bracket or angle 61 is secured to back plate 25 rearwardly thereof employing a key 62 from which is suspended and secured motor 63 which in the preferred embodiment is a DC motor. An AC motor with a feed back control could be substituted as an equivalent construction.

Motor drive shaft 65 has keyed thereto the pulley 67 which through drive belt 115 and pulley 113 is keyed upon the ball screw 103 for controlling rotation thereof in opposite directions as hereafter described.

Referring to FIGS. 9 and 10 upon the rear surface of the carriage plate 51 is mounted a pressurized source of lubricant 69 which is connected by conduit 68 to the manifold block 70. A plurality of conduits 71 at one end are connected by fittings 73 to the corresponding bearing blocks 53 and to the internal passages 77 leading to the bearings 79 corresponding shafts 57 of the cam followers or rollers 55. The opposite ends of the respective conduits 71 are connected by fittings 75 to the manifold block 70. This provides a means of providing continual lubrication to the corresponding cam follower rollers 55.

TELESCOPING MOUNT ASSEMBLY

Referring to FIGS. 2, 3 and 4, the telescoping mount assembly 49 includes side plates 81, front plate 83. The side plates 81 bridge opposite side edges of the carriage plate 51, extend rearwardly thereof in registry with the bearing blocks 53 and are secured along the length of the carriage plate 51 by a plurality of spaced cap screws 85.

Hanger mount assembly 87, FIGS. 2 and 4 is positioned between the lower ends of the side plates 81 which extend below housing 35 and is pivotally mounted thereon at 89.

Referring to FIG. 8, upright mount plate 91 is secured to the forward side of back plate 25 by fasteners 93. Lower bearing housing 95 is spaced below drive mount plate 91 and is secured to back plate 25 and mounts a pair of spaced angular contact bearings 97. Top spacer 99 upon the top bearing retainingly engages the shoulder 101 of the upright elongated ball screw 103 with a suitable seal 105 interposed. Lower spacer 99 bears against the bottom contact bearing and is retained thereon by the nut 107 threaded onto the feed screw 103 with a suitable lock washer, not shown, interposed. The back up block 109 underlies the lower bearing housing 95 reinforcing said lower bearing housing.

Radial ball bearing 111 is mounted within bearing block 112 secured upon die mount plate 91. Grease seal and spacer 114 overlie bearing 111 which recieves an upper end of the ball screw 103. Spacer 99 in registry with bearing 111 operatively engages shoulder 101 upon said screw. By this construction, the ball screw 103 is rotatively journaled and supported at its opposite ends upon back plate 25. The reduced portion of feed screw 103 within bearing 111 is keyed to the driven pulley 113 and extends through bearing 117 supported upon brake mount block 119 which mounts the electronic brake 121 suitably keyed to feed screw 103 as at 125.

The mounting of brake mount block 119 upon back plate 25 includes the upright mount block base 123 secured thereto and by suitable fasteners connected with back plate 25. Mounted upon block 119 is the encoder riser 127 which supports encoder pilot end plug 129. A series of tie rods 131 interconnect encoder pilot end plug or plate 129 with block 119.

An electronic encoder 133 is centrally mounted upon pilot end plug 129 and is secured thereto including a driven shaft 135 coaxial of feed screw 103 and coupled thereto at 137 for rotation in unison.

The electronic circuit which interconnects the encoder 133 and D.C. motor 63 is schematically shown in FIG. 8 and includes a programmable control designated by the box 143 and is connected by lead 141 to motor 63.

As an alternate, and as equivalent to the programmable control PC 143, there is shown a box 145, FIG. 8A, designating a computer numerical control (CNC) which may be connected to the circuit by the lead 141 to motor 63, instead of the programmable control 143. Encoder feed back circuit includes encoder feed back 139 connected to the encoder 133 and also connected to the programmable control 143, FIG. 8A.

Alternately, the encoder feed back may be connected to the (CNC) 145 for controlling the motor 63.

In either event, a programmable control or the equivalent computer numerical control is employed in conjunction with encoder feed back circuit 139 and responsive to the encoder 133 for controlling the speed and number of revolutions in one direction or the other of the motor shaft 65 and feed screw 103 coupled therewith.

Mounted upon feed screw 103 for selective vertical adjustments thereon is a ball nut mount assembly 147, FIG. 8, which includes ball mount bracket 149 adapted for connection to the carriage 51 centrally thereof as shown in FIG. 2. Ball mount bracket 149 has threaded thereinto as at 155 the ball nut 151 with a suitable seal 153 interposed. Nut 151 mounts at its lower end an additional seal 153 which receives ball screw 103.

Ball nut cover or anchor plate 157 underlies ball mount bracket 149 and is secured thereto by the cap screw 159 for positively anchoring the nut 151 within the bracket 149.

As shown in FIG. 8 the reservoir or manifold 70 upon back plate 25 is connected to the lower bearing assembly 97 for feed screw 103 as by the conduit 161. The upper bearings 111 and 117 are grease sealed.

SURGE TANK AND CYLINDER ASSEMBLY

The surge tank and cylinder assembly 163, FIGS. 2, 3, 4, 6 and 7 is mounted within housing 49 and is supported and mounted upon back plate 25 as is best illustrated in FIGS. 6 and 7.

A pair of laterally spaced air tight expansion surge tanks 165 are arranged within housing 49 forwardly of carriage plate 51. A plurality of laterally extending top angle brackets 167 are secured to back plate 25 as by fasteners 169 overly and secured to the upper ends of the surge tanks 165. Corresponding bottom angle brackets 171 are similarly secured to back plate 25 and project forwardly thereof and supportably mount the lower ends of the corresponding surge tanks 165, FIGS. 4 and 6.

Manifold air pipe 173 at its ends has couplings 175 for connection to the upper ends of the surge tanks 165. A source of regulated air 177 including a pressure regulator is shown in FIG. 6 and is connected by a coupling 178 to manifold pipe 173 for delivering pressurized air into and pressurizing the surge tanks 165.

The surge tank and cylinder assembly also includes the upright air cylinder 179 having a lower blind end 181 and depending therefrom a transversely apertured block 183 flexibly and pivotally mounted within the bifurcated mount bracket 185, FIGS. 6 and 7 which projects forwardly of back plate 65 and is secured thereto. Swivel pin 187 projects through mount bracket 185, end block 183 and has secured at its ends the cotter pins 189. This provides a flexible pivotal mounting for air cylinder 179 at its lower end upon said back plate within housing 35. The upper cylinder rod end 191 vented to atmosphere at 193 is connected to the blind end 181 including air cylinder 179 by a plurality of tie rods 195, FIG. 7. Flexible conduits 197 are connected by fittings 199 to the respective lower ends of the tanks 165 and are connected by fittings 201, FIG. 6 with the passages 203 in blind end 181 pressurizing the lift chamber 204 upon one side of the piston 205.

The piston assembly 205 including seal 207 has axially secured thereto piston rod 209 as by the fastener 211.

The piston rod movably projects through gland 219 in rod end 191 and at its free end extends into and is secured to rod end block 221. Said block is positioned between split mount block 59 which is secured to carriage plate 51 as by a plurality of cap screws 215.

Pivot pin 217 projects through the split mount block 59, and through rod end block 221 and is anchored by suitable cotter pins shown in FIG. 6.

HANGER MOUNT ASSEMBLY

Hanger mount assembly 87, FIGS. 1, 2 and 4 includes a pair of laterally spaced side plates 223, FIG. 4 interconnected by a pair of parallel spaced hanger tubes 225 secured thereto as by welds 227. Adjusting screw 229 having a turning nut 231 thereon anchored by spring pin 232 is journaled through the bearings 233 upon housing front plate 83 and secured thereto as by the cap screws 234, FIG. 4.

The inner end of the adjusting screw 229 is journaled and supported by additional bearings 233 upon the cross plate 259 interconnecting lower end portions of the side plates 81. Transverse adjusting bar 235 is sometimes referred to as a nut and extends transversely of side plates 81 and is adjustably secured thereto by the cap screws 241.

Each of the opposed side plates 81 have opposed horizontal slots 237, FIG. 2 which receive cap screws 241. Each of the side plates 223 of the hanger mount assembly have opposed angular slots 239 inclined at an acute angle with respect to the slots 237. The cap screw fasteners 241 extend through both sets of slots. Adjusting screw 229 is threaded through the transverse adjusting bar or nut 235 so that upon rotation of the adjusting screw, the adjusting bar is translated along the slots 237 of the side plates 281. Since the fasteners 241 extend within angular slots 239 in the side plates of the hanger mount assembly, advancement or retraction of the adjusting bar 235 will effect a corresponding angular adjustment of the side plates 223. This will effect a corresponding angular adjustment of the servo shuttle unit 277 shown in FIG. 1 for the correct angular inclination for repetitive and interrupted and reciprocal feed movements of the connected gripper head 281 into the die opening 275 with respect to the press bed B.

ELECTRO SERVO LIFT UNIT SWITCH ASSEMBLY

Figure 11:
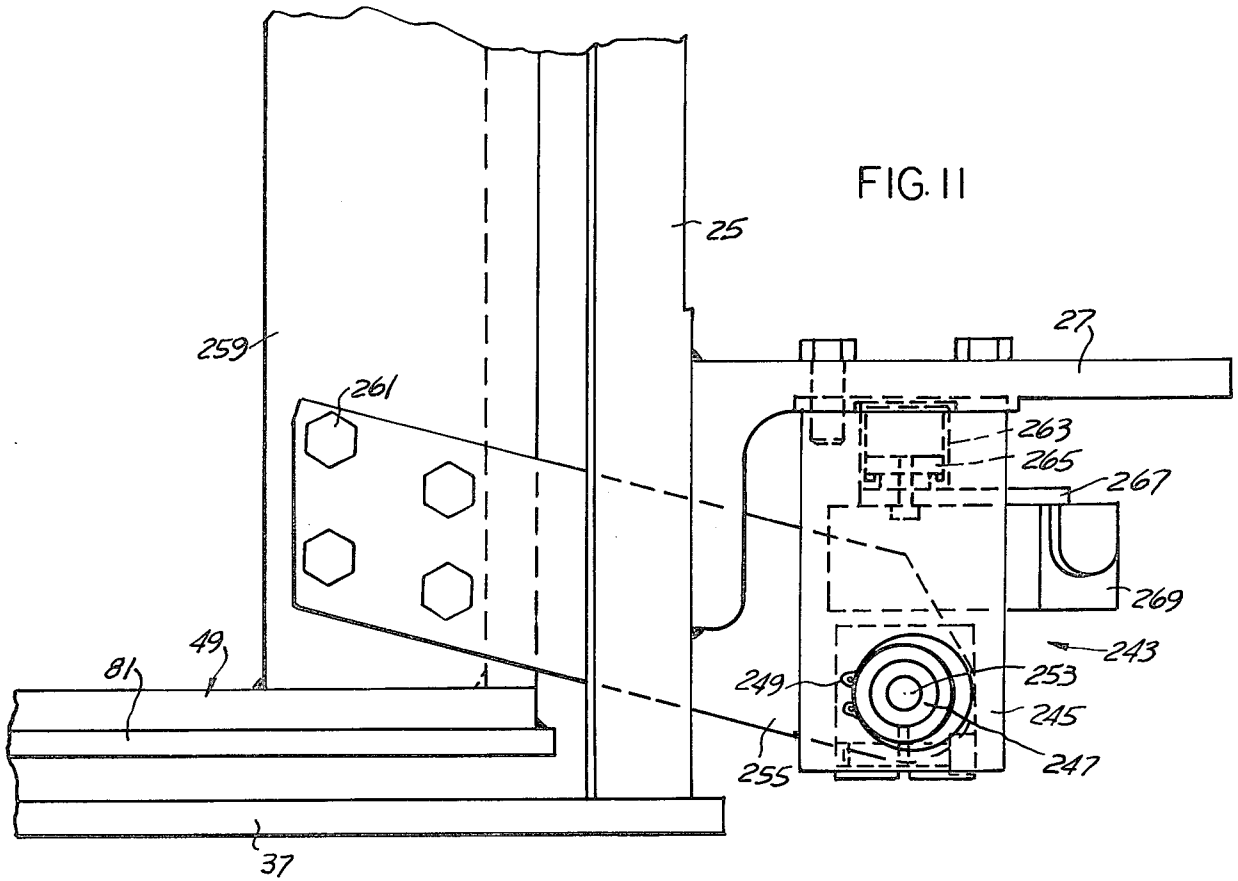
FIG. 11 is a fragmentary plan view of the electric switch assembly taken in the direction of arrows 11—11 of FIG. 2.

An electro servo lift unit switch assembly is generally indicated at 243, FIGS. 2 and 11 and includes upper and lower bushing mounts 245, FIG. 2, mounted upon angle plate 27 and including bushings 247 retained thereon by snap rings 249, FIG. 11. Vertically adjustable switch actuator plug 251, FIG. 2, is mounted upon the upright switch actuator rod 253 which is guidably mounted and positioned through the bushings 247.

The lower end of the switch actuator rod 253 is secured as at 257 to the rod mount bracket 255 mounted upon the telescoping carriage assembly 49. In this construction, FIGS. 2 and 11, side mount bracket 255 at its other end overlies the cross plate 259 which extends between the side plates 81 and is suitably secured thereto by cap screws 261.

The elongated upright switch metering channel 263 is mounted and secured upon the angle 27 inwardly of switch actuator rod 253 and has at least a pair of longitudinally spaced mount clamps 265, FIG. 11, adjustably secured therein. Each mount clamp supports outwardly of the switch metering channel 263 a transverse switch mount plate 267 mounting respectively to the upper and lower limit switches 269. The adjusted location of the respective limit switches determines the high and low limits of carriage feed movement for automatic cutoff of the power drive therefore. Thus, the respective limit switches are interconnected into an electrical circuit to the power supply to the motor 63 which drives the feed screw 103 which in turn effects timed and programmed intermittent and reciprocal movements of the carriage plate 51.

As shown in FIGS. 2 and 4, opposed lift rings 271 are secured to the outer skin or sidewalls 37 of the housing 35 to facilitate lifting of the complete assembly and positioning thereof by a suitable crane or otherwise in the initial assembly and mounting of the vertical lift assembly upon the horizontal shuttle 17 attached to the press P shown in FIG. 1.

A die loader is generally indicated at 273, FIG. 1, and is suspended from hanger mount assembly 87. Said die loader includes the servo shuttle unit 277 as set forth and described with respect to Applicant's copending U.S. patent application Ser. No. 284,559 filed on July 20, 1981. The structure, function and operation thereof the the extent necessary for an understanding of the present invention and disclosure thereof is incorporated herein. The present servo shuttle unit 277 is suspended from and secured to hanger mount assembly 87 by a pair of depending support brackets 279 which depend from transverse tubes 225 shown in FIG. 4 and are suitably secured thereto.

The loader 273 mounts a gripper head 281 or an equivalent vacuum attachment which is adapted for intermittent positioning within die opening 275 relative to bed B of the punch press P.

Once the pre-programmed vertical lift unit and carriage assembly 49 has been vertically positioned such as shown in FIG. 1 with the die loader 273 and the servo-shuttle unit 277 in registry with die opening 275 and relative to the dies upon the bed B, the servo shuttle unit as pre-programmed is adapted for longitudinal feeding movement for carrying a workpiece blank into the bed of the press.

Figure 5:
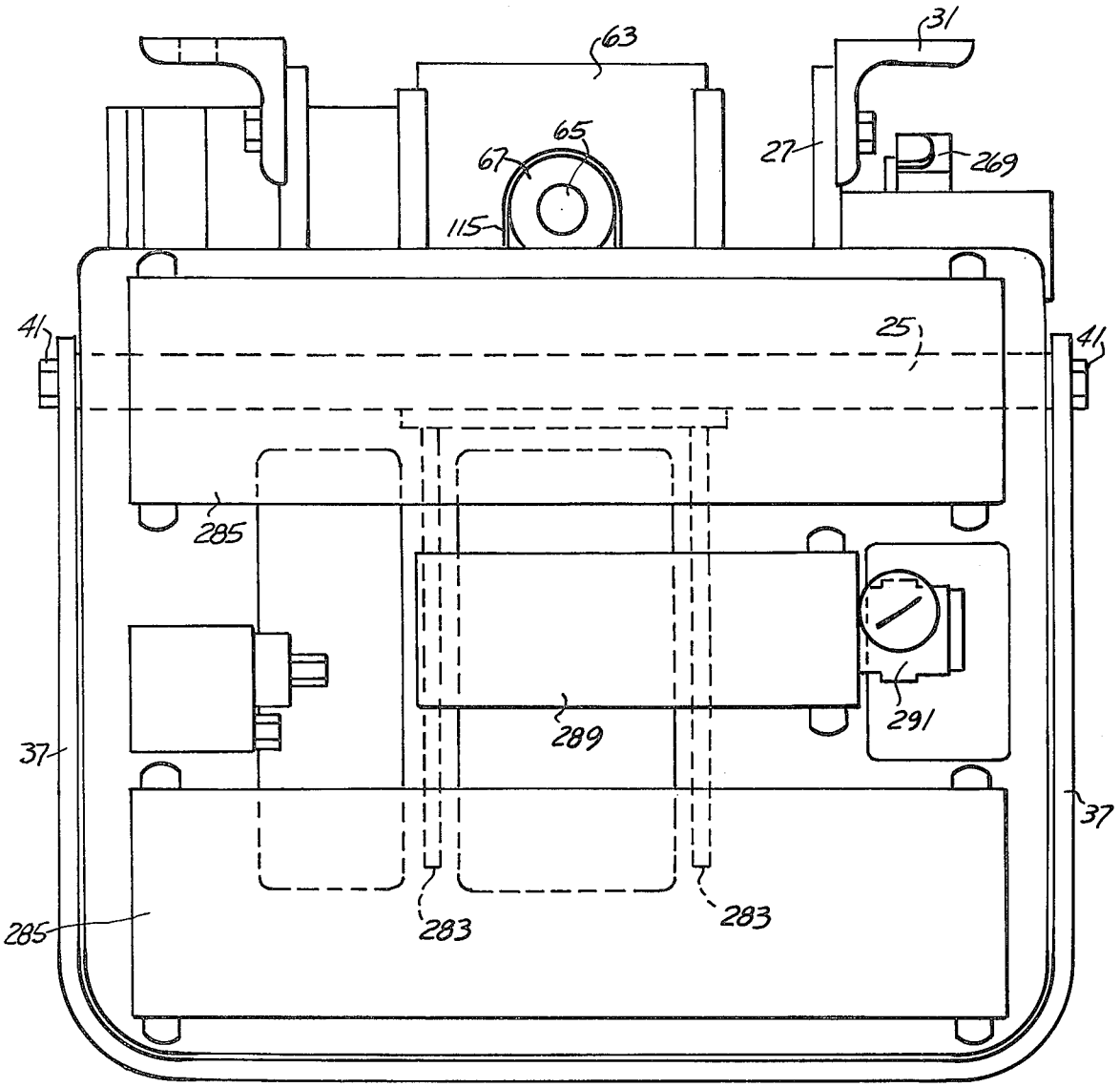
FIG. 5 is a fragmentary plan view taken in the direction of arrows 5—5 of FIG. 2.

Referring to FIGS. 2 and 5, a pair of top support angle brackets 283 project forwardly of and are secured to the back plate 25 and mount a pair of support plates 285, FIG. 5 which have mounted thereon the equipment containers 287, FIG. 2.

The central mount plate 289 further spans the brackets 283 and mounts pressure regulator 291 interposed in the pressurized air inlet 177 shown in FIG. 6.

The present electric control lift unit may be AC operated with a feedback control, but generally is a DC operated ball screw device having an encoder feedback circuit to a central PC (programmable control) or a CNC (computer numerical control). The unit is designed to accelerate to relatively high speeds and to decelerate and stop in numerous positions controlled by the preset program. The vertical lift unit is a heavy duty air counterbalanced electrically operated device for controlling vertical motion to a very accurate degree.

As shown in FIG. 8, the drive assembly mounted upon base plate 25 is easily accessible so that it my be removed as an integral assembly for service and repair.

OPERATION

The die loader 273 and the present vertical lift unit 11 are attached to an intermediate cross shuttle bracket assembly 17, FIG. 1, and in turn mounted to the customer or users punch press P, fragmentarily shown. The cross shuttle bracket 17–23 allows the vertical lift unit 11 to be positioned at the press die opening 275. The servo shuttle unit 277 is attached to and suspended from the vertical lift unit. Its telescoping carriage assembly 273 functions and operates in accordance with U.S. patent application Ser. No. 284,559 filed on July 20, 1981.

Vertical lift unit 11 reciprocates upon a vertical axis and is coupled to the electro-servo shuttle unit 277. This comprises a two axis automatic lift and carry assembly programmable within the confines of the mechanism as controlled on a preset program either from the programmable control 143 or the computer numerical control 145 shown in FIG. 8.

The necessary pneumatic pressure is applied at 177, FIG. 6 to the tank and cylinder assembly 165–179, FIGS. 6 and 7 and the pressurized air delivered to the tanks 165 feeds into the lift chamber 204 of the cylinder assembly 179. This counter balances the weight of the mechanism carried by the reciprocal travel carriage 49 of FIG. 1, including the hanger mount assembly 87 thereunder, the die loader 273, the servo shuttle unit 277 and the workpiece blank mounted on the gripper head 281. Accordingly, the feed screw 103 and its motor drive 63 is loaded only to the extent necessary of feeding the nut assembly 147 which is connected to the reciprocating carriage plate 51 of the telescoping carriage assembly 49.

On a signal from the press P, the electric shuttle unit 273 may be directed forward or in reverse, with a gripper head 281, or equivalent vacuum attachment to pick up a part, to extract a part, or to load a part into the die area. This works in unison with the vertical lift unit 11 which is programmed to work in unison with the electro servo shuttle unit 277. The present vertical lift unit is powered up and down by the ball screw drive 103 which through the nut assembly 147 carries the carriage assembly 49, the shuttle unit hanger mount 87 thereon. The vertical lift unit is programmed to stop and start with great precision in any position within the confines of the engineering design. Such a vertical lift may be used to control the vertical positioning of the gripper head 281 or vacuum attachment with respect to a stack of workpiece blanks and gripping a workpiece blank, transporting the workpiece blank to registry within the press opening 275 with respect to the bed B upon which is a conventional die for use in the punch press operation and the retraction of the gripper head 281.

After the press operation, forming operation or other machining upon the workpiece, the gripper head 281 is returned by its servo shuttle unit 277 to grip the workpiece, to retract the workpiece from the bed and thereafter the vertical lift unit is programmed to transport the finished workpiece to a secondary loading area. Such transportation may also occur laterally with respect to the horizontal shuttle unit 17, shown in FIG. 1.

Under the control from the present program control 143 or the computer numerical control 145, shown in FIG. 8, in conjunction with encoder 133 and the encoder feedback circuit 139 to the motor 63, the output of the motor shaft 65 and its direction of rotation and the number of rotations of its drive shaft and the feed screw 103 coupled therewith is so controlled as to provide a programmed repetitive cycle of predetermined feed movements of the telescoping carriage assembly 49 and the adjustable cradle support 87 depending therefrom.

For effecting a proper counter balancing of the telescoping carriage as loaded, an amp. meter is arranged across the field of the DC motor 63 and the pressure regulator 177–291, FIG. 5 is adjusted so that the average will read the same on both the up cycle and the down cycle. If a greater sophistication is required, the load could be controled with servo motor control of the pressure regulator feed from the program control 143 or the computer numerical control 145, FIG. 8.

Having described our invention, reference should now be had to the following claims:

We claim:

1. A lift unit for a punch press having a bed and a die opening comprising a housing including an upright back plate mountable upon said press;

a pair of upright parallel spaced tracks within said housing mounted upon and spaced forwardly of said backplate;

an upright feed screw journaled and supported upon and spaced forwardly of said back plate;

a carriage including an upright carriage plate spaced forwardly of said feed screw;

vertically spaced bearing blocks secured upon outer edges of said carriage plate rearwardly thereof, each bearing block supporting a plurality of right angularly related cam followers operatively engaging opposite sides of said tracks and the opposite outer edges thereof for guidably mounting said carriage plate upon said tracks for reciprocal movements thereon;

a nut mount assembly secured to said carriage plate including a nut threadedly receiving said screw;

a motor mounted upon said back plate having a drive shaft parallel to and coupled with said feed screw;

said carriage extending below said housing;

an adjustable support cradle mounted upon and depending from said carriage adapted to mount a workpiece gripper tool adapted for programmed reciprocal movements in a substantially horizontal plane relative to said die opening and bed;

and an electronic encoder axially connected to said feed screw and electrically connected to said motor for controlling the direction and number of rotations of its drive shaft for effecting a programmed repetitive cycle of predetermined vertical feed movements of said carriage.

2. In the lift unit of claim 1, a hanger means upon and projecting from said backplate secured to said press;

said hanger means including a pair of spaced upright first angles extending along and secured to said backplate;

and upright second angles adjustably secured to said first angles respectively, having a series of longitudinally spaced fastener apertures therein for securing registry with said press.

3. In the lift unit of claim 1, the mounting of said tracks including longitudinally spaced track supports upon said backplate secured to said tracks.

4. In the lift unit of claim 1, said feed screw being interposed between said tracks.

5. In the lift unit of claim 1, each of said cam followers including a roller having a stud shaft mounted upon said bearing blocks for a snug rolling registry with opposite sides and edges of said tracks respectively.

6. In the lift unit of claim 5, said bearing blocks having lubricant passages to said cam follower shafts;

a lubricant manifold mounted upon said carriage plate, connected to a source of pressurized lubricant;

and a plurality of conduits at their one ends connected to said manifold and at their other ends connected to said bearing block passages respectively.

7. In the lift unit of claim 1, the mounting of said feed screw including spaced bearing housings with bearings mounted upon and projected from said backplate supporting and journaling said feed screw adjacent its opposite ends.

8. In the lift unit of claim 7, pulleys mounted respectively upon said feed screw and motor drive shaft;

and drive belt interconnecting said pulleys.

9. In the lift unit of claim 1, said carriage being of U-shape in plan including a pair of spaced side plates spanning, secured to and extending rearwardly of said carriage plate and engaging said bearing blocks;

said adjustable cradle support being mounted upon and depending from said side plates.

10. In the lift unit of claim 9, said cradle including a pair of spaced upright cradle end support plates pivotally mounted centrally at their lower ends upon said side plates;

a pair of parallel spaced mount bars interposed between end portions of said plates and secured thereto;

a manually adjustable hanger bar interposed between and connected to the upper ends of said cradle end support plates and adjustably mounted upon said carriage side plates for presetting the angle of a plane passing through said mount bars;

the manual adjustment of said hanger bar including an adjusting screw having a nut secured thereto and journaled upon said carriage parallel to its side plates and threaded through said hanger bar.

11. In the lift unit of claim 10, a shuttle hanger bracket mounted upon and depending from said cradle support;

a shuttle assembly secured to said shuttle hanger and including a trackway extending substantially transverse of said carriage;

a horizontal carriage reciprocally mounted upon said trackway;

and an automatic gripper head extractor suspended from said carriage and mounting said workpiece tool for controlled reciprocal movements in a substantially horizontal plane relative to said die opening and bed.

12. In the lift unit of claim 1, a shuttle hanger bracket mounted upon and depending from said cradle support;

a shuttle assembly secured to said shuttle hanger bracket and including a trackway extending substantially transverse of said carriage;

a horizontal carriage reciprocally mounted upon said trackway;

and an automatic gripperhead extractor suspended from said carriage and mounting said workpiece gripper tool.

13. In the lift unit of claim 1, a cylinder and surge tank weight compensation assembly mounted upon said back plate forwardly of said carriage plate, having a cylinder assembly including an upright cylinder at its blind end pivotally mounted upon said back plate, a reciprocal piston and a piston rod extending above the rod end of said cylinder and at its upper end pivotally connected to said carriage for counterbalancing the load thereon;

said piston defining a lift chamber adjacent said blind end and a rod end chamber communicating with atmosphere;

said surge tank assembly including an upright elongated pressurized surge tank at its ends mounted upon said back plate and connected to a source of regulated air pressure;

there being a passage in the cylinder blind end;

and a flexible conduit interconnecting said surge tank with said passage.

14. In the lift unit of claim 13, the mounting and suspension of said cylinder assembly and surge tank including angle brackets secured to a projecting forwardly of said back plate engaging the top and bottom of said surge tank and pivotally supporting the blind end of said cylinder;

said cylinder and surge tank being nested within said housing and arranged outwardly of said carriage.

15. In the lift unit of claim 14, there being a pair of laterally spaced parallel surge tanks within said housing upon opposite sides of said cylinder;

the pressurizing of said surge tanks including a manifold pipe overlying said tanks and connected to a source of pressurized air;

a pressure regulator interposed in said manifold pipe;

and outlet pipes interconnecting said manifold and said surge tanks respectively.

16. In the lift unit of claim 1, a preset programmable control (PC) connected to said motor;

and an electronic encoder feedback circuit interconnecting said encoder and PC.

17. In the lift unit of claim 1, a preset computer numerical control connected to said motor;

and an electronic encoder feedback circuit interconnecting said encoder and said computer numerical control.

18. In the lift unit of claim 1, an upright angle plate along the length of said back plate;

an electro servo lift unit switch assembly including vertically spaced upper and lower limit switches mounted on said angle plate and connected to said motor;

an upright switch actuator rod slidably mounted upon and along said angle plate and at one end connected to said carriage;

and a switch actuator plug mounted upon said switch actuator rod adapted for passing registry with said limit switches alternately for deactivating said motor at predetermined extreme positions of said carriage relative to said housing.

19. In the lift unit of claim 18, an upright switch metering channel mounted upon said angle plate adjacent and along said actuating rod and spaced therefrom;

said limit switches being adjustably mounted upon and along said metering channel.

20. In the lift unit of claim 14, the mounting of said limit switches upon said metering channel including a mount clamp for each limit switch slidably adjustable within and secured to said metering channel.

21. In the lift unit of claim 18, the connection of said switch actuator rod to said carriage including a cross-plate interconnecting the side plates of said carriage at its lower end;

and a rod mount bracket at one end secured to said cross plate and at its other end secured to said switch actuator rod adjacent its lower end.

22. In the lift unit of claim 18, the slide mounting of said switch actuator rod including a pair of spaced bushing supports mounting bushings, secured to said angle plate and guidably receiving said switch actuator rod.

* * * * *